US006533016B2

(12) United States Patent
Hansch

(10) Patent No.: US 6,533,016 B2
(45) Date of Patent: Mar. 18, 2003

(54) METHOD AND APPARATUS FOR JOINING SUPPLEMENTARY PRODUCTS TO PRINTED PRODUCTS

(75) Inventor: Egon Hansch, Wetzikon (CH)

(73) Assignee: Ferag AG, Hinwil (CH)

( * ) Notice: Subject to any disclaimer, the term of this patent is extended or adjusted under 35 U.S.C. 154(b) by 74 days.

(21) Appl. No.: 09/729,479

(22) Filed: Dec. 4, 2000

(65) Prior Publication Data

US 2001/0004918 A1 Jun. 28, 2001

(30) Foreign Application Priority Data

Dec. 28, 1999 (CH) ..... 2385/99

(51) Int. Cl.[7] ..... B65C 9/00; B65C 9/08

(52) U.S. Cl. ..... 156/556; 156/538; 156/557; 156/566; 156/568; 156/DIG. 28

(58) Field of Search ..... 156/566, 567, 156/556, 564, 569, 570, DIG. 28, DIG. 31, DIG. 30, 538, 539, 557

(56) References Cited

U.S. PATENT DOCUMENTS 4,478,668 A * 10/1984 Gau ..... 118/231
4,844,769 A * 7/1989 Kronseder ..... 156/378
5,632,476 A 5/1997 Stauber
5,636,832 A 6/1997 Honegger et al.
5,643,432 A * 7/1997 Qiu ..... 205/122
5,645,679 A 7/1997 Hansch
6,234,231 B1 * 5/2001 Boss et al. ..... 156/556

* cited by examiner

*Primary Examiner*—Richard Crispino
*Assistant Examiner*—Sue A. Purvis
(74) *Attorney, Agent, or Firm*—Brinks Hofer Gilson & Lione

(57) ABSTRACT

The apparatus, which serves to join flat supplementary products provided with an adhesive to printed products, has n holding elements which are driven on a circulating path about a first axis, by means of which supplementary products are gripped individually at at least one pick-up point and, after an appropriate rotation about the first axis, can be joined to a printed product at a discharge point. As they are transported from the pick-up point to the discharge point, the holding elements, which are mounted such that they can rotate about a second axis running at least approximately parallel to the first axis, are rotated about the second axis and guided into the area of the printed products, which are conveyed in a suspended manner and on a second path at least approximately tangentially to the circulating path, after which, at the discharge point, a printed product, opened if appropriate, is supported laterally by means of a leading or trailing holding element and, by means of the leading or trailing holding element, is joined to a supplementary product at an envisaged point.

20 Claims, 4 Drawing Sheets

METHOD AND APPARATUS FOR JOINING SUPPLEMENTARY PRODUCTS TO PRINTED PRODUCTS

FIELD OF THE INVENTION

The invention relates to a method and an apparatus for joining flat supplementary products provided with an adhesive to printed products.

BACKGROUND OF THE INVENTION

A method and an apparatus of this type are disclosed by U.S. Pat. No. 5,645,679 (EP 0 675 062 B1). This gives a description of a transport apparatus by means of which supplementary products, such as labels, goods samples or "post-it"® products can be joined to printed products which are stored in a processing device.

For this purpose, the supplementary products, which are present in stacked form, are gripped individually by the transport device by means of transport clamps that are fixed to carrying arms and steering elements in such a way that they can be controlled, transported and discharged to printed products which, in the processing device, are collected in straddling form on stable wall elements driven in circulation or are inserted into stable pick-up parts that are driven in circulation. At the time of transfer, the supplementary products are pressed by means of the transport clamps against the printed products held by the wall elements, and are joined to them. In order that supplementary products provided with adhesive can be joined correctly to printed products in this way, skilful control of the transport clamps is necessary. The processing device which is needed in addition to the transport device has to be constructed in a stable manner and synchronized with the transport device. Within the processing flow of the printed products, two additional transfers also result between the processing device and transport devices by means of which printed products are fed to the processing device and removed from the latter again.

SUMMARY OF THE INVENTION

The present invention is therefore based on the object of providing a method and an apparatus for joining supplementary products to printed products which is constructed simply and permits the printed products to be delivered with a low outlay.

In order to join the supplementary products to the printed products, the invention provides a number of holding elements that are driven on a circulating path about a first axis, by means of which supplementary products fed by a first conveyor or present on a stack are gripped individually at a pick-up point and, after an appropriate rotation about the first axis, are joined to printed products, which are transported in a suspended manner by a second conveyor, at a discharge point. For this purpose, a freely suspended printed product is supported by the apparatus according to the invention by means of a supporting element and, by means of a holding element arranged on the opposite side of the printed product to the supporting element, is joined to a supplementary product at an envisaged point.

The significant factor here is that the holding of the printed product when it is being joined to a supplementary product is not done by the conveyor provided to convey the printed products, nor by the processing device provided for the intermediate storage of the printed products, but by supporting elements, preferably holding elements, belonging to the apparatus according to the invention.

The apparatus according to the invention can therefore be used in existing conveying systems at points at which the printed products are transported in a freely suspended manner, without being intermediately stored in a processing device. The apparatus can therefore be used flexibly in existing or new systems without additional investments. The matching support needed for the application of the supplementary products is in this case provided by the supporting elements belonging to the apparatus according to the invention.

As opposed to the apparatus disclosed by U.S. Pat. No. 5,632,476 (EP 0 666 186 A1), by means of which the outer part of printed products transported in a suspended manner are provided with an adhesive on mutually opposite edges and thereby can be sealed off, the apparatus according to the invention permits supplementary products, for example product samples, to be fixed at any desired point outside or inside an opened printed product.

BRIEF DESCRIPTION OF THE DRAWINGS

The invention will be explained in more detail below using exemplary embodiments and with reference to the drawing, in which.

DESCRIPTION OF THE PREFERRED EMBODIMENT

Figure 1:
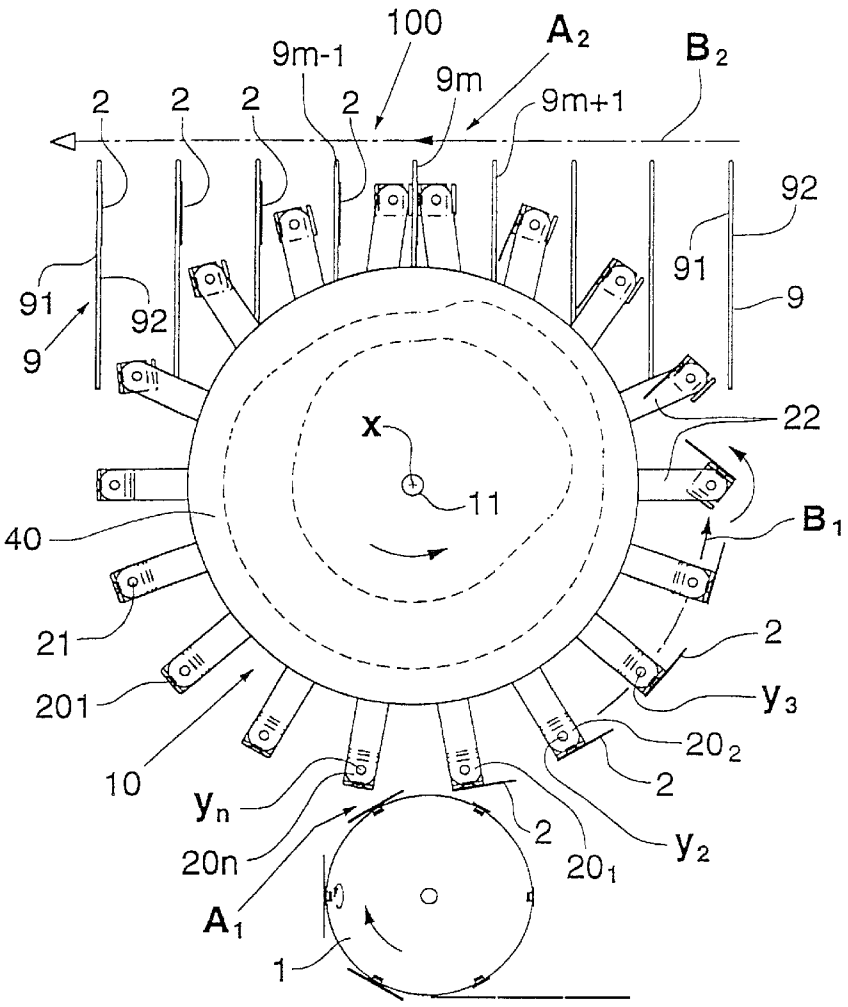
FIG. 1 shows an apparatus according to the invention, by means of which supplementary products are joined to the trailing side of printed products.

FIG. 1 shows an apparatus 10 according to the invention by means of which flat supplementary products 2 provided with an adhesive are accepted from a first conveyor 1 at a pick-up point A1, transported along a first path B1 to a discharge point A2 and are there joined to the trailing side 92 of printed products 9, which are guided in a suspended manner along a second path B2 by a second conveyor 100.

The apparatus according to the invention has n holding elements $\mathbf{20}_1, \mathbf{20}_2, \ldots, \mathbf{20}_n$ which are driven on the first path B1 around a first axis x and by means of which the supplementary products 2 are gripped individually at the pick-up point A1, following appropriate rotation about the first axis x are guided into the area of the printed products 9 and are joined to a printed product $\mathbf{9}_m$ at the discharge point A2. For this purpose, the holding elements $\mathbf{20}_1$, $\mathbf{20}_2, \ldots, \mathbf{20}_n$ are mounted such that they can rotate about a second axis $y_1; y_2; \ldots; y_n$ running at least approximately parallel to the first axis x, so that the holding elements $\mathbf{20}_1$, $\mathbf{20}_2, \ldots, \mathbf{20}_n$ can be rotated into a position suitable to pick up and discharge the supplementary products 2 at the pick-up and discharge points A1, A2.

The holding elements $\mathbf{20}_1$, $\mathbf{20}_2$, . . . , $\mathbf{20}_n$ are preferably provided with a suction head 201 (see e.g., FIG. 6), which at the pick-up point A1 is aligned at least approximately parallel to the supplementary products 2 supplied and, at the discharge point A2 is aligned at least approximately parallel to the printed products 9. If the holding elements $\mathbf{20}_1$, $\mathbf{20}_2$, . . . , $\mathbf{20}_n$ are equipped with a gripper, a clamp or the like, their alignment at the pick-up and discharge points A1, A2 must be adapted accordingly.

At the pick-up point A1, the supplementary products 2 can be supplied by the first conveyor 1 or, as shown in U.S. Pat. No. 5,636,832 (EP 0 675 061 B1), FIG. 1, for example, taken directly from a stack or, as shown in U.S. Pat. No. 5,632,476 (EP 0 666 186 A1), FIG. 5 or PCT application WO 99/06285, FIG. 1, separated from a band or strip and kept ready to be picked up or transferred immediately. This band can be a supporting band, to which the supplementary products 2 adhere and are detached therefrom during the conveying operation. However, the strip or the band can also form the basis of the supplementary products 2, which are cut off from the strip and provided with an adhesive 3, if the latter is not already present.

Figure 2:
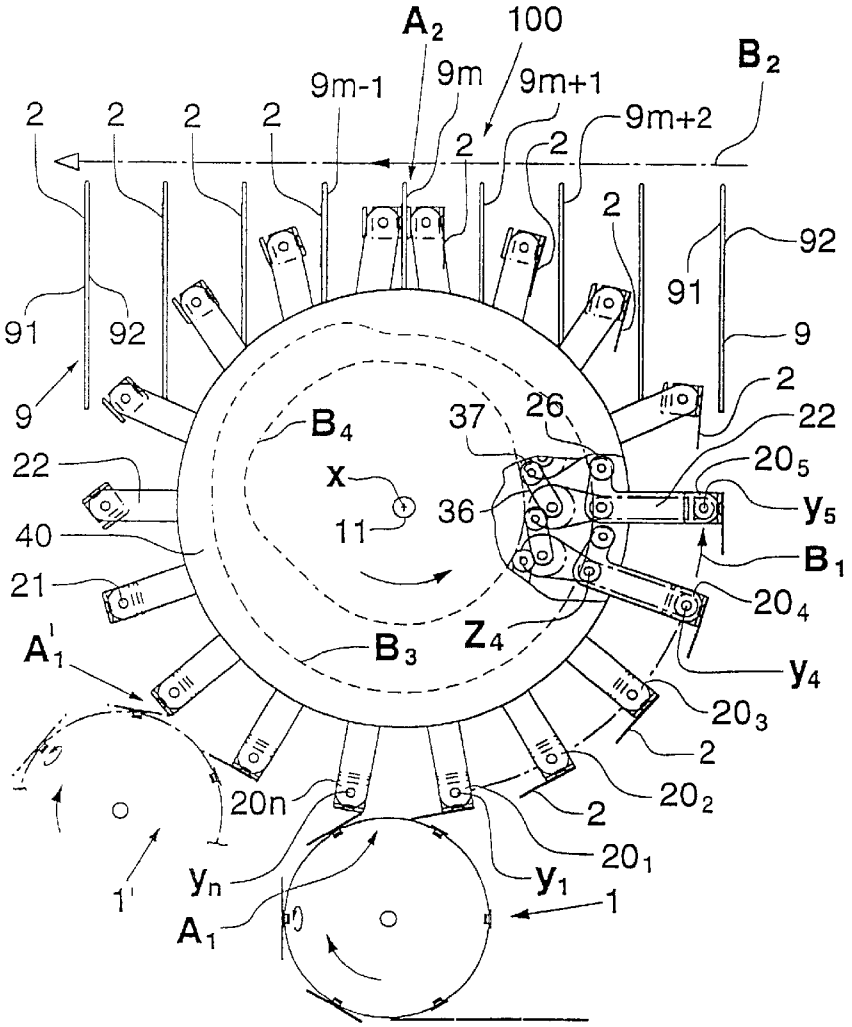
FIG. 2 shows the apparatus according to FIG. 1 during the joining of supplementary products to the leading side of printed products.

In the preferable configurations of the invention shown in FIG. 1 and FIG. 2, supplementary products 2 are gripped at the pick-up point A1, if necessary at a further pick-up point A1', are aligned vertically so as to trail (see FIG. 1) or lead (see FIG. 2) during their transport to the discharge point A2 by the holding element $\mathbf{20}_1$; $\mathbf{20}_2$; . . . ; $\mathbf{20}_n$, are guided between the printed products 9 and joined to a printed product $\mathbf{9}_m$ at the discharge point A2.

The operation of discharging a supplementary product 2 onto a printed product $\mathbf{9}_m$ by means of a holding element $\mathbf{20}_n$; $\mathbf{20}_{n-1}$ leading and trailing and carrying the supplementary product according to FIG. 1 will be described in more detail below.

Figure 3B:
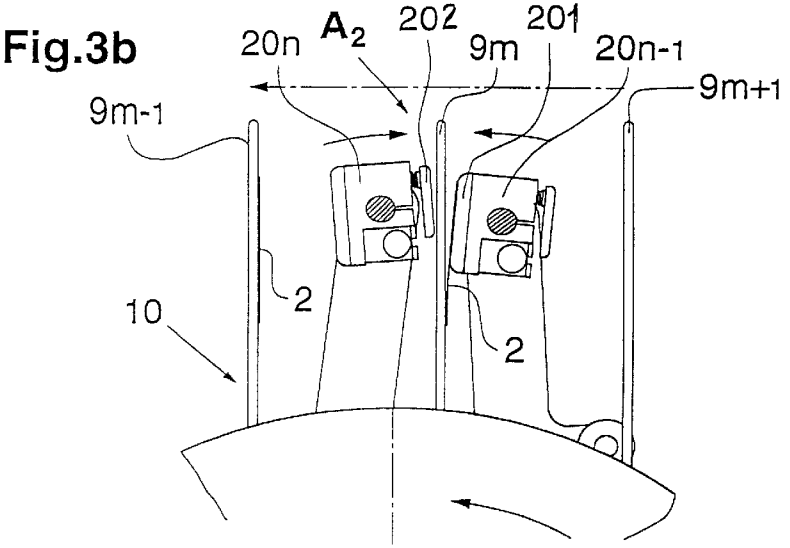
FIGS. 3*a*, 3*b*, 3*c*, and 3*d* show the operation of discharging a supplementary product onto a printed product by means of a trailing holding element carrying the supplementary product and a leading holding element that is supporting the printed product and which has already discharged the supplementary product onto the leading printed product.
Figure 3A:
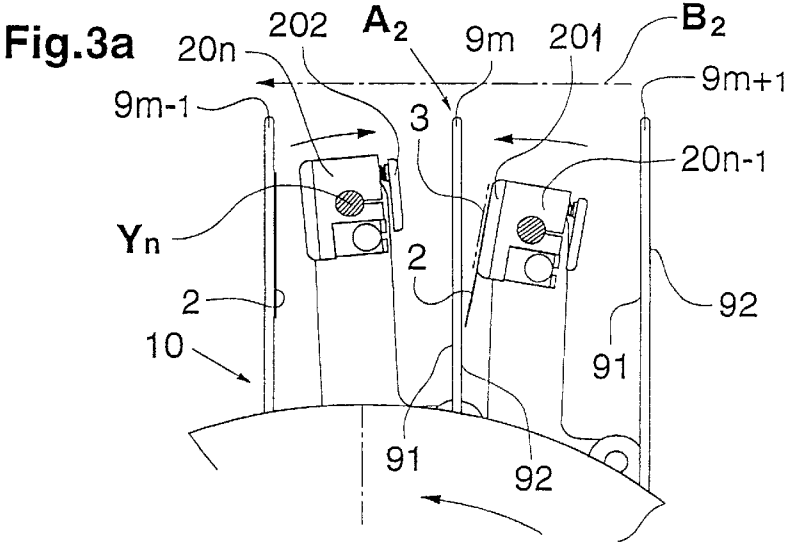
Figure 3D:
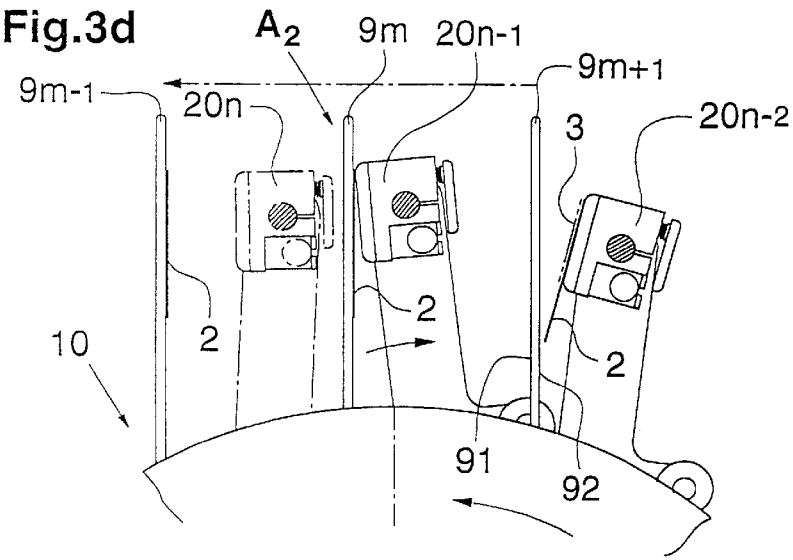
Figure 3C:
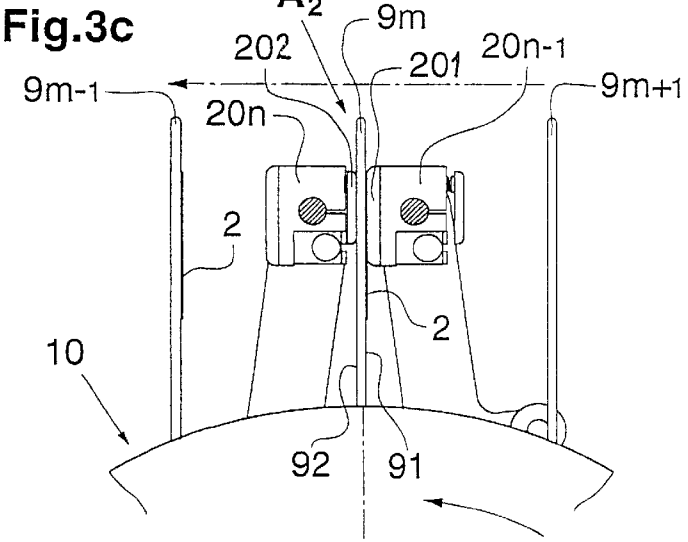

As shown in FIGS. 3*a*–3*d*, the holding element $\mathbf{20}_{n-1}$ provided with the supplementary product 2 is guided from the rear against the trailing side 92 of the printed product $\mathbf{9}_m$, while the leading holding element $\mathbf{20}_n$ is guided with a supporting element 202 against the leading side 91 of the printed product $\mathbf{9}_m$, until the supplementary product 2 with the adhesive layer 3 applied to it is pressed firmly against the printed product $\mathbf{9}_m$ supported by the leading holding element $\mathbf{20}_n$ (see FIG. 3*c*). As FIG. 3*d* shows, the printed product $\mathbf{9}_m$ provided with the supplementary product 2 is subsequently released again. The holding element $\mathbf{20}_{n-1}$ is guided back against the leading side 91 of the next printed product $\mathbf{9}_{m+1}$, to whose trailing side 92 a supplementary product 2 is then applied by means of the next trailing holding element $\mathbf{20}_{n-2}$.

Each of the holding elements $\mathbf{20}_1$; $\mathbf{20}_2$; . . . ; $\mathbf{20}_n$ therefore has a dual function. During one revolution about the axis x, a holding element $\mathbf{20}_{n-1}$ transports a supplementary product 2 from the pick-up point to the discharge point A1; A2 and discharges it onto a printed product $\mathbf{9}_m$. In addition, at the discharge point A2, an adjacent printed product $\mathbf{9}_{m+1}$ or $\mathbf{9}_{m-1}$ is supported in order that a supplementary product 2 can be applied to it by means of a leading or trailing holding element $\mathbf{20}_n$; $\mathbf{20}_{n-2}$. In this case, the supporting function can be carried out after the discharge of the supplementary product 2 (see FIG. 1) or before the discharge of the supplementary product 2 (see FIG. 2).

While in FIG. 1 the supplementary products 2 are fixed to the trailing side 92 of the printed products 9, in FIG. 2 they are fixed to the leading side 91 of the printed products 9. Each holding element $\mathbf{20}_1$; $\mathbf{20}_2$; . . . ; $\mathbf{20}_n$ is therefore rotated in FIG. 2, after picking up a supplementary product 2, about the axis $y_1$; $y_2$; . . . ; $y_n$ in such a way that the supplementary product 2 trails the holding element $\mathbf{20}_1$; $\mathbf{20}_2$; . . . ; $\mathbf{20}_n$ at the discharge point A2, and, like the printed products 9, is aligned at least approximately vertically.

The function of the elements belonging to the apparatus which provide the movement (rotation about the second axis y and inclination about a third axis z) of the holding elements $\mathbf{20}_1$, $\mathbf{20}_2$, . . . ; $\mathbf{20}_n$, which are illustrated in a detail in FIG. 2, will be explained in more detail below with reference to FIG. 6.

Figure 4:
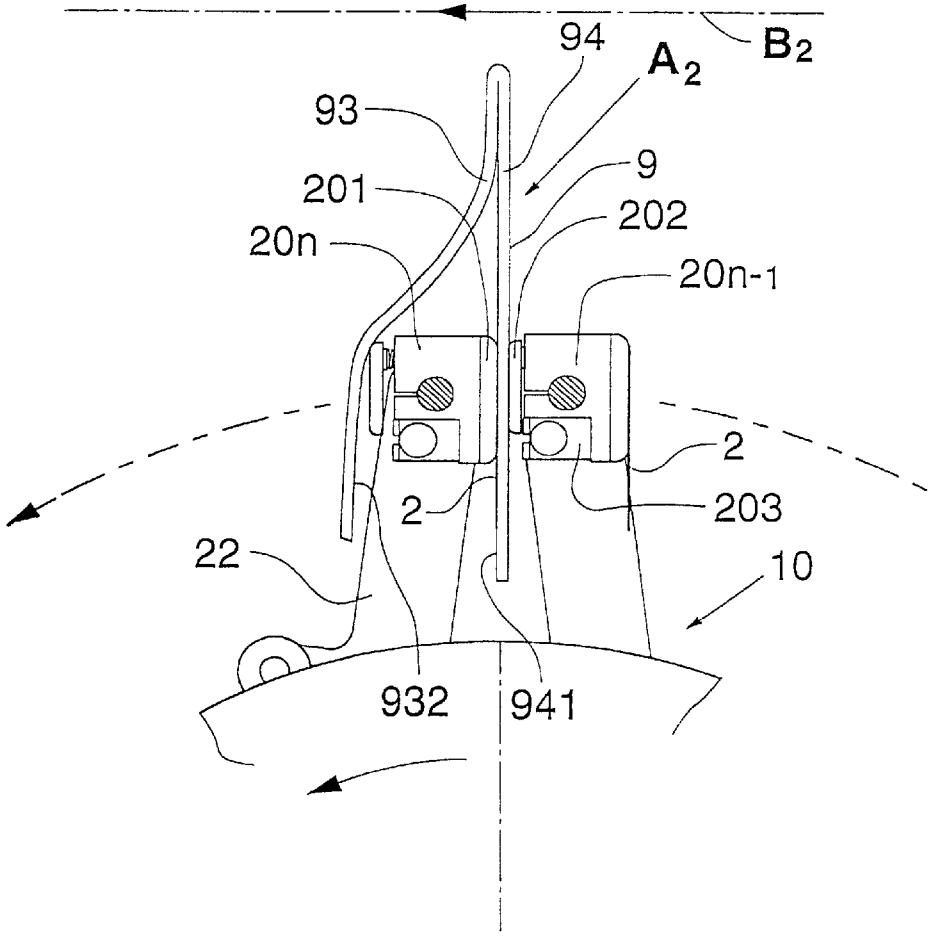
FIG. 4 shows the apparatus according to FIG. 1 during the joining of supplementary products to the leading side of a trailing limb of an opened printed product.

From FIG. 4, it can be seen that, by means of the apparatus according to the invention, supplementary products 2 can also be fixed to printed products 9 which have a number of limbs 93, 94. If the limbs 93, 94 are open, supplementary products 2 can also be fixed to their inner sides 932, 941 in the manner described above. FIG. 4 shows the holding elements $\mathbf{20}_n$, $\mathbf{20}_{n-1}$ of the apparatus 10 during the joining of a supplementary product 2 to the leading side 941 of a trailing limb 94 of a printed product 9. Here, it can be seen that the supporting function is provided before the discharge of the supplementary product 2.

Figure 5:
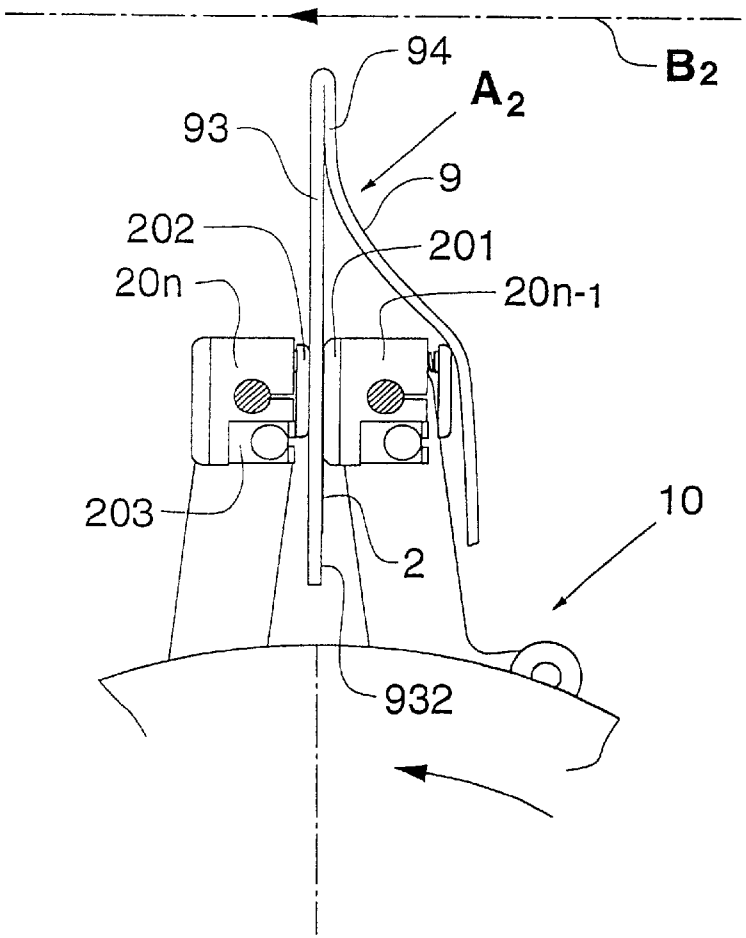
FIG. 5 shows the apparatus according to FIG. 1 during the joining of supplementary products to the trailing side of a leading limb of an opened printed product.

FIG. 5 shows the holding elements $\mathbf{20}_n$, $\mathbf{20}_{n-1}$ of the apparatus 10 during the joining of a supplementary product 2 to the trailing side 932 of a leading limb 93 of a printed product 9, which has been opened upstream by means, for example, of measures disclosed by the laid-open publication EP 0 564 812 A1.

Figure 6:
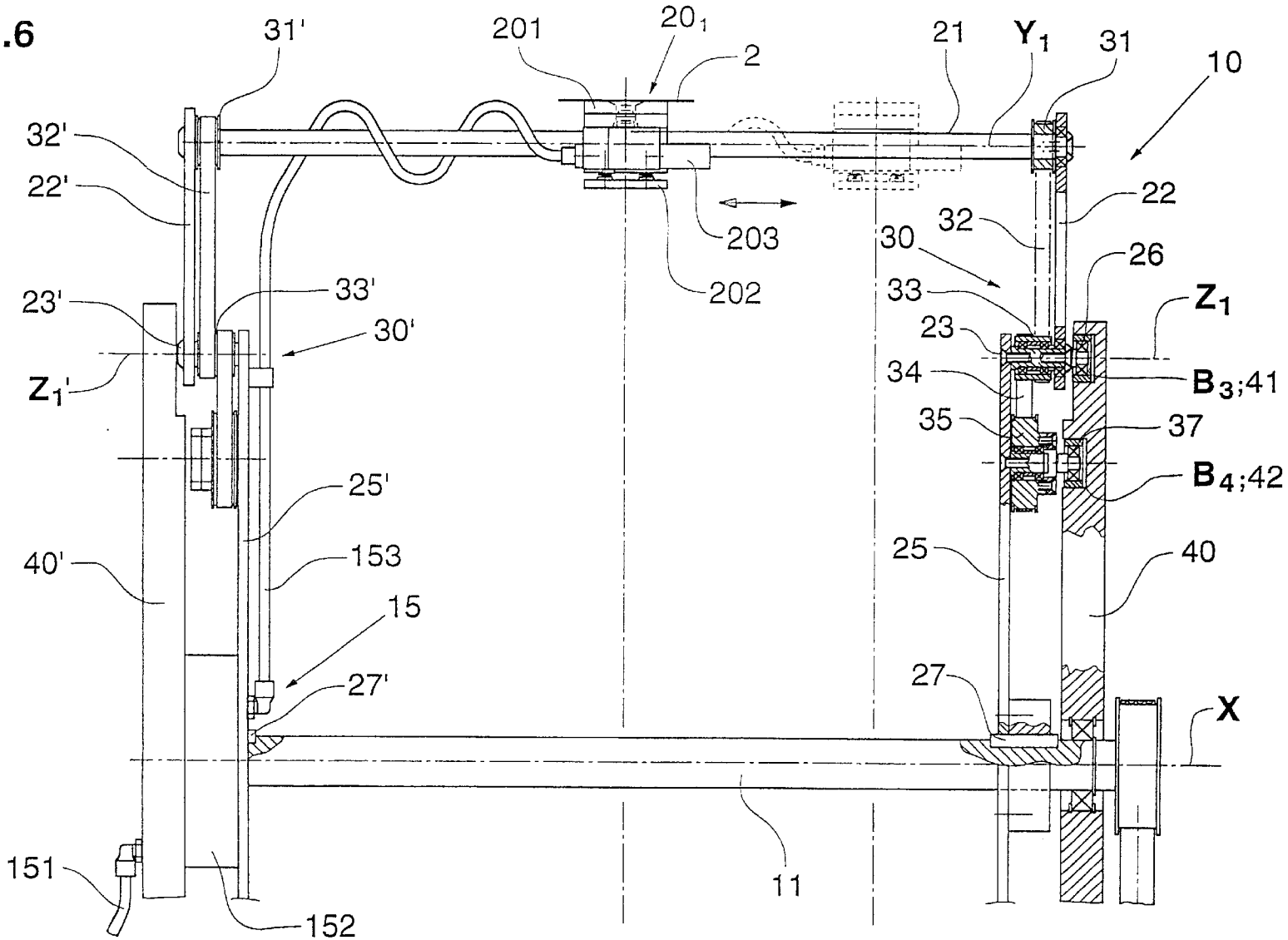
FIG. 6 shows the apparatus according to FIG. 1 in a preferable configuration.

FIG. 6 shows the apparatus 10 according to the invention in a preferable configuration, with a holding element $\mathbf{20}_1$ which is firmly connected to a shaft 21 that can be rotated about the second axis $y_1$. The shaft 21 is rotatably mounted at both ends in levers 22, 22' which, by means of shafts 23, 23' aligned along a third axis $z_1$, are rotatably connected to carrying elements 25, 25', which are fixed by means of flanged hubs 27, 27' to a drive shaft 11 aligned along the first axis x.

As illustrated in a detail in FIG. 6, the lever 22 is provided with a wheel 26 which is spaced apart from the third axis z1 and which, during the rotation of the carrying element 25 about the first axis x, which rotation is preferably carried out at a constant angular speed, is guided on a third path B3, which is machined into a non-rotating slotted guide 40 aligned parallel to the carrying element 25, as a guide groove 41.

The distance of the third path B3 from the first axis x runs as a function of the angle of rotation about the first axis x such that, in particular at the pick-up point and the discharge point A1; A2, the pivoting or inclination of the lever 22 needed to pick up or discharge the supplementary products 2 is achieved.

In addition, in the preferred configuration, the shaft 21 is provided at both ends with a drive wheel 31; 31', which is connected via a first drive belt 32; 32' to a coupling wheel 33; 33' which is aligned at least approximately coaxially with the third axis z1; z1' and which is connected via a second drive belt 34; 34' to a control wheel 35; 35' fixed to the carrying element 25; 25'. As shown in FIG. 2, the control wheel 35; 35' is connected via a control lever 36 to a wheel 37 which, during the rotation of the carrying element 25 about the first axis x, is guided on a fourth path B4, which is machined into the slotted guide 40 as a guide groove 42.

The distance of the fourth path B4 from the first axis x is selected as a function of the angle of rotation about the first axis x in such a way that, in particular at the pick-up point and the discharge point A1; A2, a rotation of the holding elements $20_1, 20_2, \ldots, 20_n$ about the second axis $y_1; y_2; \ldots; y_n$, needed to pick up and discharge the supplementary products 2, is achieved.

Instead of the above described drive device with drive wheel 31; 31', coupling wheel 33; 33' and control wheel 35, 35', which are connected to one another by the first and second drive belts 32; 32' and 34; 34', respectively, any desired further suitable drive means, such as gearwheels, chains, etc., can be used for controlling the position of the shaft 21.

In order to grip and hold supplementary products 2, the holding elements $20_1, 20_2, \ldots, 20_n$ are provided with a suction head 201, which is connected, via an ejector 203 serving as a jet pump with a suction action, to a compressed-air device 15.

The compressed-air device 15 comprises a rotary valve 152 which is seated on the shaft 11, whose rotor is in each case connected via a line 153 to an ejector 203 and which, by means of a bearing, is rotatably mounted in a stator connected to a compressed-air line 151 such that an air duct for each holding element $20_1; 20_2; \ldots; 20_n$ is formed in the rotary valve 152. The air pressure (vacuum) within the suction element 201 is controlled on the basis of the position of the holding elements $20_1, 20_2, \ldots 20_n$, so that at the pick-up point A1 a supplementary product 2 can be picked up by suction and, after being transported, can be released again at the discharge point A2. Instead of the above described compressed-air device 15, by means of which the necessary suction action is produced by increasing the flow velocity in the ejectors 203, a negative pressure system can also be used, by means of which the air is sucked out of the ducts in the suction head 201 as required.

By means of the apparatus according to the invention, the supplementary products 2 can be applied to the printed products 9 at any desired point. For this purpose, the holding elements $20_1, 20_2, \ldots 20_n$ are fixed to the associated shafts 21 at appropriately selected positions. In addition, two or more holding elements $20_1, 20_2, \ldots, 20_n$ can be arranged on each shaft 21. As FIG. 2 shows, in addition a number of pick-up points A1, A1' can be provided, at which supplementary products 2 can be accepted from first conveyors 1, 1' arranged behind one another or beside one another. As indicated in the drawing of FIG. 6, the holding elements $20_1, 20_2, \ldots, 20_n$ are aligned on the shaft 21 in accordance with the position of the first conveyors 1, 1'.

The holding members $20_1, 20_2, \ldots, 20_n$ can preferably be controlled individually or in groups in such a way that supplementary products 2 can optionally be accepted from a first conveyor 1, 1' or from a stack at the first or a further pick-up point A1, A1'.

The shafts 21 provided with the holding elements $20_1, 20_2, \ldots, 20_n$ are, as described above, preferably held at both ends by carrying elements 25, 25' and levers 22, 22', and controlled by means of slotted guides 40, 40' and drive means, for example the belt drive 30, 30' shown in FIG. 6. However, the provision of holding means and/or control means on only one side is also possible.

Although the holding elements $20_1, 20_2, \ldots, 20_n$ are preferably provided with suction heads, the use of gripping tools, such as clamps, is also possible. The number of holding elements $20_1, 20_2, \ldots, 20_n$ and shafts 21 is preferably selected such that a smooth transfer of the supplementary products 2 at the pick-up and the discharge points A1, A2 can take place.

In the preferred configurations of the invention shown in FIG. 1-FIG. 6, the holding elements $20_1, 20_2, \ldots, 20_n$ have a dual function, being provided to hold a supplementary product 2 and to support a printed product 9. Also possible is the use of holding and supporting elements which are provided alternately in the apparatus and which, because of the reduced functionality, can be controlled more simply, so that their movement relative to the printed products 9 can also be effected with other means. The holding members $20_1, 20_2, \ldots, 20_n$ shown, for example, in FIG. 1 are in this case equipped alternately with only suction heads 201 or supporting elements 202.

If other means are provided to move the suction heads 201 and supporting elements 202, it may be possible to dispense with the rotation about the second and/or third axis y; z. The deflection of the suction heads 201 and supporting elements 202 can then, for example, be carried out in another way, even pneumatically, mechanically, electrically or magnetically.

The course of the first and second paths B1; B2, on which the supplementary products 2 and the printed products 9 are transported preferably runs concentrically or coaxially with the axis x in the area of the discharge point A2, in order that the transfer can be made more easily and more precisely.

A1though in the apparatus shown in FIG. 1 to FIG. 6 the supplementary products 2 are inserted from below into the area of the printed products 9, insertion from the side or from above is likewise possible.

In addition, the supporting and holding elements can run on paths separated from each other. The movement on the first path B1 from the pick-up point A1 to the discharge point A2 is of course needed only for the holding elements $20_1, 20_2, \ldots, 20_n$ serving to transport the supplementary products 2. A reduced number of supporting elements can also be provided. At least one supporting element is needed, and in each case is provided on the side 91; 92 of the printed product 9 located opposite the holding element $20_1; 20_2; \ldots; 20_n$ carrying a supplementary product 2 to be discharged, in order to support said printed product 9.

While a preferred embodiment of the invention has been described, it should be understood that the invention is not so limited, and modifications may be made without departing from the invention. The scope of the invention is defined by the appended claims, and all devices that come within the meaning of the claims, either literally or by equivalence, are intended to be embraced therein.

What is claimed is:

1. A method of joining flat supplementary products provided with an adhesive to printed products, having a number of holding elements which are driven on a circulating path around a first axis, by means of which supplementary products are gripped individually at at least one pick-up point and, after an appropriate rotation about the first axis, are joined to a printed product at a discharge point, wherein the holding elements, as they are transported from the pick-up point to the discharge point, are guided into the area of the printed products, which are conveyed in a suspended manner and on a second path at least approximately tangentially to the circulating path, after which, at the discharge point, a printed product, opened if appropriate, is supported on the appropriate side by means of a supporting element and, by means of a holding element arranged on the opposite side of the printed product to the supporting element, is joined to a supplementary product at an envisaged point, and wherein during the transfer from the pick-up point to the discharge point, the holding elements, which are mounted such that they can rotate about a second axis running at least approximately parallel to the first axis, are rotated about the second axis into a position suitable for the discharge.

2. The method as claimed in claim 1, wherein the printed product is supported by a holding element acting as supporting element.

3. The method as claimed in claim 2, wherein each holding element is moved around the first axis by means of a carrying element arranged on a shaft and, by means of a lever that is pivotably connected to the carrying element, is inclined forward or backward, in the direction of circulation, about a third axis aligned parallel to the first axis, in order, at the discharge point, to support a printed product or to join it to a supplementary product.

4. The method as claimed in claim 1, 2 or 3, wherein each holding element has a suction head which serves to pick up supplementary products, is connected to a vacuum device or, via an ejector serving as a jet pump with a suction action, to a compressed-air device, and which can pick up a supplementary product by suction at the pick-up point and release it again at the discharge point.

5. The method as claimed in claim 1, 2 or 3, wherein the printed products, which are conveyed tangentially along the second path, preferably longitudinally or transversely with respect to the first path, are aligned at least approximately transversely with respect to the direction of circulation of the holding elements.

6. Apparatus for joining flat supplementary products provided with an adhesive to printed products, having a number of holding elements which are driven on a circulating path around a first axis, by means of which flat supplementary products provided with an adhesive can be gripped individually at at least one pick-up point and, after an appropriate rotation about the first axis, can be joined to a printed product at a discharge point wherein, as they are transported from the pick-up point to the discharge point, the holding elements, which are mounted such that they can rotate about a second axis running at least approximately parallel to the first axis, can be guided into the area of the printed products, which are conveyed in a suspended manner and on a second path at least approximately tangentially to the circulating path, and wherein, at the discharge point, a printed product, opened if appropriate, is supported on an appropriate side by means of a supporting element and, by means of a holding element arranged on the opposite side of the printed product to the supporting element, can be joined to a supplementary product at an envisaged point.

7. The apparatus as claimed in claim 6, herein at least one holding element acts as supporting element.

8. The apparatus as claimed in claim 7, wherein each of the holding elements is connected to a shaft which is aligned along the second axis and is rotatably mounted in a lever, which is preferably fixed, such that it can be pivoted about a third axis aligned parallel to the first axis, to a carrying element driven by a drive shaft aligned along the first axis.

9. The apparatus as claimed in claim 8, wherein the lever is provided with a wheel which is spaced apart from the third axis and, during the rotation of the carrying element, is guided around the first axis on a third path, which is machined into a slotted guide, preferably as a guide groove.

10. The apparatus as claimed in claim 9, wherein the distance of the third path from the first axis is selected as a function of the angle of rotation, on the basis of the rotation of the carrying element about the first axis, in such a way that, in particular at the pick-up and discharge points, the pivoting of the lever needed to pick up and discharge the supplementary products is achieved.

11. The apparatus as claimed in claim 10, wherein the shaft is connected by form-fitting drive means to a guide element, preferably a wheel, which, during the rotation of the carrying element, is guided around the first axis on a fourth path, which is machined into the slotted guide, preferably as a guide groove.

12. The apparatus as claimed in claim 11, wherein the shaft is provided with a drive wheel, which is connected via a first drive belt to a coupling wheel which is aligned at least approximately coaxially with the third axis, and which is connected via a second drive belt to a control wheel which is fixed to the carrying element and which is connected via a control lever to the wheel.

13. The apparatus as claimed in claim 12, wherein the distance of the fourth path from the first axis is selected on the basis of the rotation of the carrying element about the first axis in such a way that, in particular at the pick-up and discharge points, a rotation of the holding elements about the second axis, needed to pick up and discharge the supplementary products, is achieved.

14. The apparatus as claimed in any one of the claims 6 to 13, wherein each holding element has a suction head which serves to pick up supplementary products and is connected to a vacuum device or, via an ejector serving as a jet pump with a suction action, to a compressed-air device.

15. The apparatus as claimed in any one of the claims 8–13, wherein the holding elements can be fixed on the associated shafts at optionally defined positions.

16. The apparatus as claimed in any one of the claims 6 to 14, wherein the holding elements can be controlled individually or in groups in such a way that supplementary products can be accepted at the first or a further pick-up point.

17. The apparatus as claimed in any one of the claims 8 to 13, wherein the shafts are held at both ends by carrying elements and levers, and are controlled by means of slotted guides and drive means.

18. The apparatus as claimed in any one of the claims 8–13, wherein two or more holding elements are arranged on one or more shafts.

19. The apparatus as claimed in any one of the claims 8–13, wherein the holding elements can be fixed on the associated shafts at optionally defined positions and two or more holding elements are arranged on one or more shafts.

20. The apparatus as claimed in claim 6, wherein the supporting element is guided on the circulating path.

* * * * *